US010986864B1

(12) United States Patent
Arabia

(10) Patent No.: US 10,986,864 B1
(45) Date of Patent: Apr. 27, 2021

(54) CHILLED WATER PIPE AND A RETROFIT APPARATUS FOR CHILLING A WATER PIPE

(71) Applicant: Jaafar Arabia, Nazareth (IL)

(72) Inventor: Jaafar Arabia, Nazareth (IL)

( * ) Notice: Subject to any disclaimer, the term of this patent is extended or adjusted under 35 U.S.C. 154(b) by 0 days.

(21) Appl. No.: 16/833,718

(22) Filed: Mar. 30, 2020

(51) Int. Cl.
*A24F 1/30* (2006.01)
*A24F 40/57* (2020.01)
*A24F 1/06* (2006.01)

(52) U.S. Cl.
CPC ..... *A24F 1/30* (2013.01); *A24F 1/06* (2013.01); *A24F 40/57* (2020.01)

(58) Field of Classification Search
None
See application file for complete search history.

(56) References Cited

U.S. PATENT DOCUMENTS

2009/0077992 A1* 3/2009 Anderson ..... B01D 5/009 62/291
2014/0130812 A1* 5/2014 Kling ..... A24F 1/30 131/173
2015/0037616 A1* 2/2015 Wyatt ..... H01M 10/0481 429/7
2017/0099873 A1* 4/2017 Benjamignan ..... H05B 1/0244
2020/0141624 A1* 5/2020 Drobnis ..... F25B 21/02

* cited by examiner

*Primary Examiner* — Michael H. Wilson
*Assistant Examiner* — Katherine A Will

(57) ABSTRACT

Disclosed is a water pipe comprising an inner heat sink positioned within a water chamber of the water pipe, an outer heat sink positioned outside the water chamber of the water pipe, a thermoelectric cooler (TEC) having a heat absorbing side connected to the inner heat sink and a heat rejecting side connected to the outer heat sink, an electric power source for supplying power to the TEC and a controller configured to adjust power supply from the electric power source to the TEC.

17 Claims, 10 Drawing Sheets

CHILLED WATER PIPE AND A RETROFIT APPARATUS FOR CHILLING A WATER PIPE

FIELD OF THE INVENTION

The present invention generally relates to the field of smoking devices and water pipes. More specifically, the present invention relates to a chilled water pipe and a retrofit apparatus for chilling a water pipe.

BACKGROUND

A hookah, is a single or multi-stemmed instrument for vaporizing and smoking flavored *cannabis*, tobacco (often Mu'assel), or sometimes opium, whose vapor or smoke is passed through a water basin or chamber—often glass-based—before inhalation.

Nowadays, instead of copper, brass, and low quality alloys, manufacturers increasingly use stainless steel and aluminum. Silicone rubber compounds are used for hookah hoses instead of leather and wire. New materials make modern hookahs more durable, eliminate odors while smoking and allow washing without risks of corrosion or bacterial decay. New technologies and modern design trends are changing the appearance of hookahs.

Despite the obvious benefits of modern hookahs, because of high production cost and lack of modern equipment in traditional hookah manufacturing regions, most hookahs are still produced with older technologies.

There is a need in the field of smoking devices, such as water pipes and hookahs, for improved smoking devices and/or smoking device retrofit apparatuses to chill the interior of the water-pipe/hookah—heated by its external environment and by heat radiated from the burning of charcoal and the material being smoked (e.g. Tabaco). Systems, devices, apparatuses and methods described herein, facilitate the chilling of a water-pipe's/hookah's interior, thus lowering the temperature of smoke/vapor inhaled by the smoker, improving the smoking experience and enhancing client satisfaction.

SUMMARY OF THE INVENTION

According to some embodiments of the present invention, there may be provided a water pipe having a chilling apparatus for chilling the interior of a water chamber of the water pipe.

According to some embodiments, an inner heat sink may be positioned within the water chamber of the water pipe, an outer heat sink may be positioned outside the water chamber of the water pipe. A Thermoelectric Cooler (TEC), having a heat absorbing side and a heat rejecting side, may be positioned between the outer and inner heat sinks, such that the heat absorbing side is adjacently connected to the inner heat sink and the heat rejecting side is adjacently connected to the outer heat sink. A layer of thermal cream may be spread/positioned between the surfaces connecting the TEC to the heat sinks.

An electric power source may supply electric power to the Thermoelectric Cooler (TEC). A controller may be configured to adjust the power supply from the electric power source to the TEC based on commands received from a user control panel or interface and/or based on measured values received from one or more sources such as: a clock—based on preset operation times or length of operation/operation-halt; charging circuitry—based on remaining power supply of battery); a thermometer—based on the temperature measured within and/or outside a water chamber of the water pipe; and/or based on any other sensor(s) monitoring the space within the water pipe or the environment surrounding it.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings:

Figure 1:
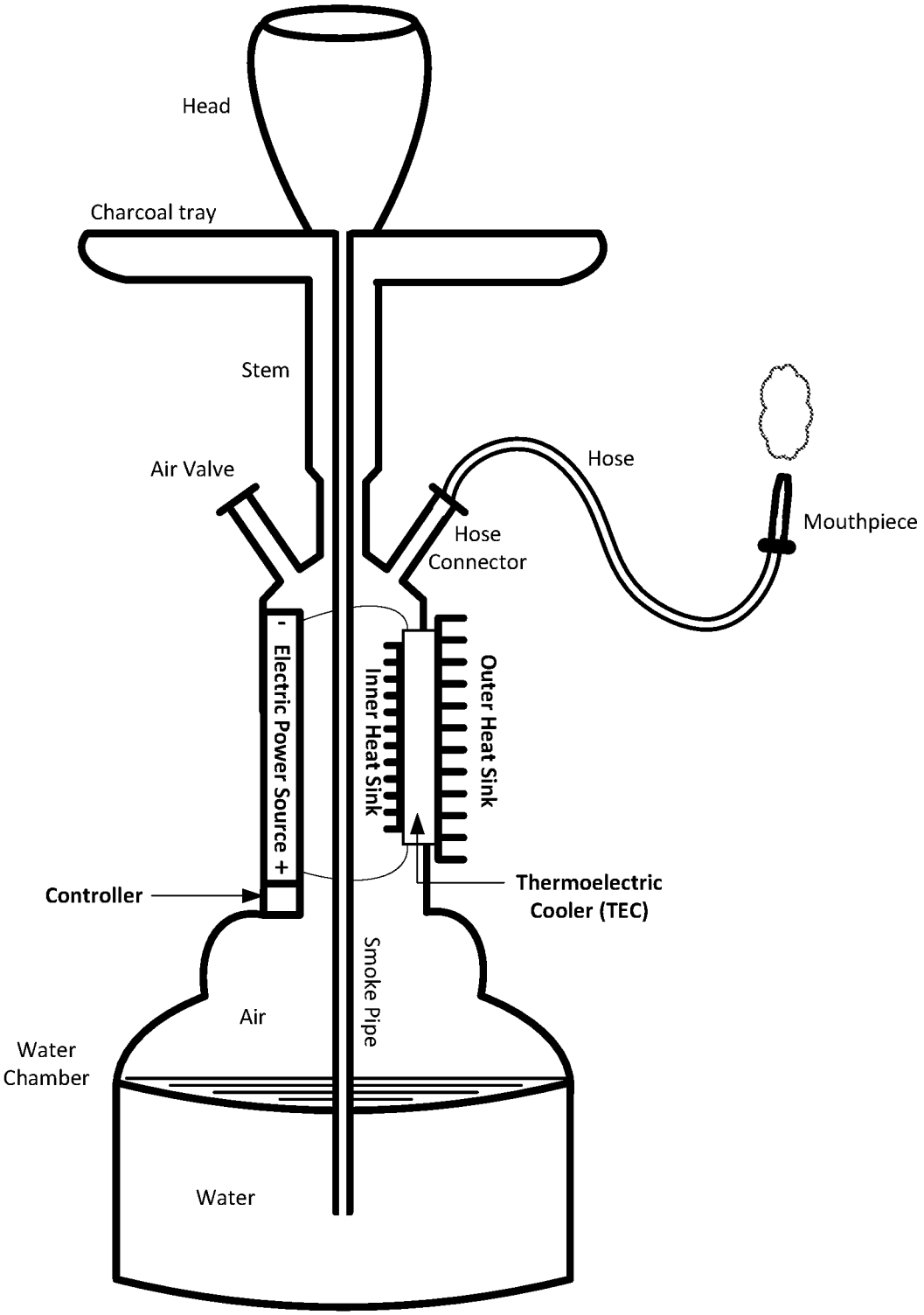
FIG. 1, is a schematic diagram of an exemplary hookah water pipe including a thermoelectric cooling apparatus, in accordance with some embodiments of the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals or element labeling may be repeated among the figures to indicate corresponding or analogous elements.

DETAILED DESCRIPTION

In the following detailed description, numerous specific details are set forth in order to provide a thorough understanding of some embodiments. However, it will be understood by persons of ordinary skill in the art that some embodiments may be practiced without these specific details. In other instances, well-known methods, procedures, components, units and/or circuits have not been described in detail so as not to obscure the discussion.

Functions, operations, components and/or features described herein with reference to one or more embodiments, may be combined with, or may be utilized in combination with, one or more other functions, operations, components and/or features described herein with reference to one or more other embodiments.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "includes", "including", "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

The present disclosure is to be considered as an exemplification of the invention, and is not intended to limit the invention to the specific embodiments illustrated by the figures or description below.

Throughout the following description, the terms 'Waterpipe', 'Water Pipe' or the like, may relate to any type or types combination of a water or liquid pipe, including but not limited to: a hookah, a nargila, a bong, a pipe, a vaporizer and/or any other fluid utilizing smoking device or apparatus, known today or to be devised in the future.

According to some embodiments of the present invention, there may be provided a water pipe having a chilling apparatus for chilling the interior of a water chamber of the water pipe.

According to some embodiments, an inner heat sink may be positioned within the water chamber of the water pipe, an outer heat sink may be positioned outside the water chamber of the water pipe. A Thermoelectric Cooler (TEC), having a heat absorbing side and a heat rejecting side, may be positioned between the outer and inner heat sinks, such that the heat absorbing side is adjacently connected to the inner heat sink and the heat rejecting side is adjacently connected to the outer heat sink. A layer of thermal cream may be spread/positioned between the surfaces connecting the TEC to the heat sinks.

An electric power source may supply electric power to the Thermoelectric Cooler (TEC). A controller may be configured to adjust the power supply from the electric power source to the TEC based on commands received from a user control panel or interface and/or based on measured values received from one or more sources such as: a clock—based on preset operation times or length of operation/operation-halt; charging circuitry—based on remaining power supply of battery); a thermometer—based on the temperature measured within and/or outside a water chamber of the water pipe; and/or based on any other sensor(s) monitoring the space within the water pipe or the environment surrounding it.

According to some embodiments, an outer fan may be connected to the outer heat sink. The fan may displace air carrying heat rejected by the outer heat sink, replacing it with colder air, thereby facilitating/enhancing the chilling pace and/or chilling capability of the interior of the water pipe's chamber.

According to some embodiments, an inner fan may be connected to the inner heat sink. The fan may displace colder air at the proximity of the inner heat sink, to direct air carrying heat accumulated within the chamber of the water pipe towards the inner heat sink, thereby facilitating/enhancing the chilling pace and/or chilling capability of the interior of the water pipe's chamber.

The controller may be configured to adjust the power supply from the electric power source to the outer fan and/or the inner fan based on commands received from a user control panel or interface and/or based on measured values received from one or more sources such as: a clock—based on preset operation times or length of operation/operation-halt; charging circuitry—based on remaining power supply of battery); a thermometer—based on the temperature measured within and/or outside a water chamber of the water pipe; and/or based on any other sensor(s) monitoring the space within the water pipe or the environment surrounding it.

According to some embodiments, the outer sink may take the form of a cooling block, wherein the cooling block may be a liquid (e.g. water) filled cooling block. Liquid/water may be pumped: through the cooling block while absorbing TEC rejected heat, through a radiator to reject to the environment heat absorbed by the liquid, into a water reservoir and from the reservoir back to the water block through the pump.

According to some embodiments, the water pipe may include a rechargeable battery to power the TEC, the heat sink fan(s), the water cooling block pump and/or a radiator fan. According to some embodiments, the water pipe may include an AC to DC converter, connected to a socket of an electric grid, to power the TEC, the heat sink fan(s), the water cooling block pump and/or the radiator fan.

According to some embodiments, the water pipe may include a thermometer positioned within the water chamber intermittently providing temperature readings to the controller. The controller may adjust power supply to the TEC, the heat sink fan(s), the water cooling block pump and/or the radiator fan, based on temperature reading values received.

According to some embodiments, a measured temperature value above a predefined threshold value may trigger or enhance the operation of the TEC, heat sink fan(s), the water cooling block pump and/or the radiator fan; or, a set of measured temperature values—optionally within a predefined period of time—above a predefined threshold value may trigger or enhance the operation of the TEC, heat sink fan(s), the water cooling block pump and/or the radiator fan.

According to some embodiments, a measured temperature value below a predefined threshold value may halt or diminish the operation of the TEC, heat sink fan(s), the water cooling block pump and/or the radiator fan; or, a set of measured temperature values—optionally within a predefined period of time—below a predefined threshold value may halt or diminish the operation of the TEC, heat sink fan(s), the water cooling block pump and/or the radiator fan.

According to some embodiments, a chilling apparatus as described herein may be integrated into a water pipe as part of the water pipe's production and/or may be retrofitted into an existing water pipe.

According to some embodiments, the chilling apparatus may be positioned and retained within a complementing hole or opening in the water chamber of the water pipe. According to some embodiments, the chilling apparatus may be positioned in relation to the water pipe and retained, such that: the inner heat sink is mostly or completely within the water chamber; the outer heat sink is mostly or completely outside the chamber; and, the TEC complements the hole or opening in the water chamber and its thickness dimension at least partially overlaps with the wall (e.g. glass wall/layer) of the water chamber.

Reference is now made to FIG. 1, where there is shown a schematic diagram of an exemplary hookah water pipe including a thermoelectric cooling apparatus, in accordance with some embodiments of the present invention. In the figure, there is show a water pipe including: a head, a charcoal tray, a stem, an air valve, a hose connector, a hose and a hose mouthpiece and a water chamber.

A smoke pipe runs vertically from the head, through the stem and the air at the top of the water chamber and extends further into the water at the bottom of the chamber. Smoke from substance (e.g. tobacco) burning in the head is sucked down through the smoke pipe and exits the smoke pipe in the chamber waters. It is then pulled into the hose connector and travels through the hose to exit from the mouthpiece and into the smoker's mouth, throat and lungs. The passing of the smoke through the water in the water chamber: partially filters, cleans and/or chills the smoke—to make for a better smoking experience.

The TEC shown is operated by the controller and powered by the electric power source. The TEC transfers heat absorbed by the inner heat sink from within the water chamber to the outer heat sink that rejects it to the environment, thereby chilling the interior of the water chamber lowering its temperature.

Figure 2:
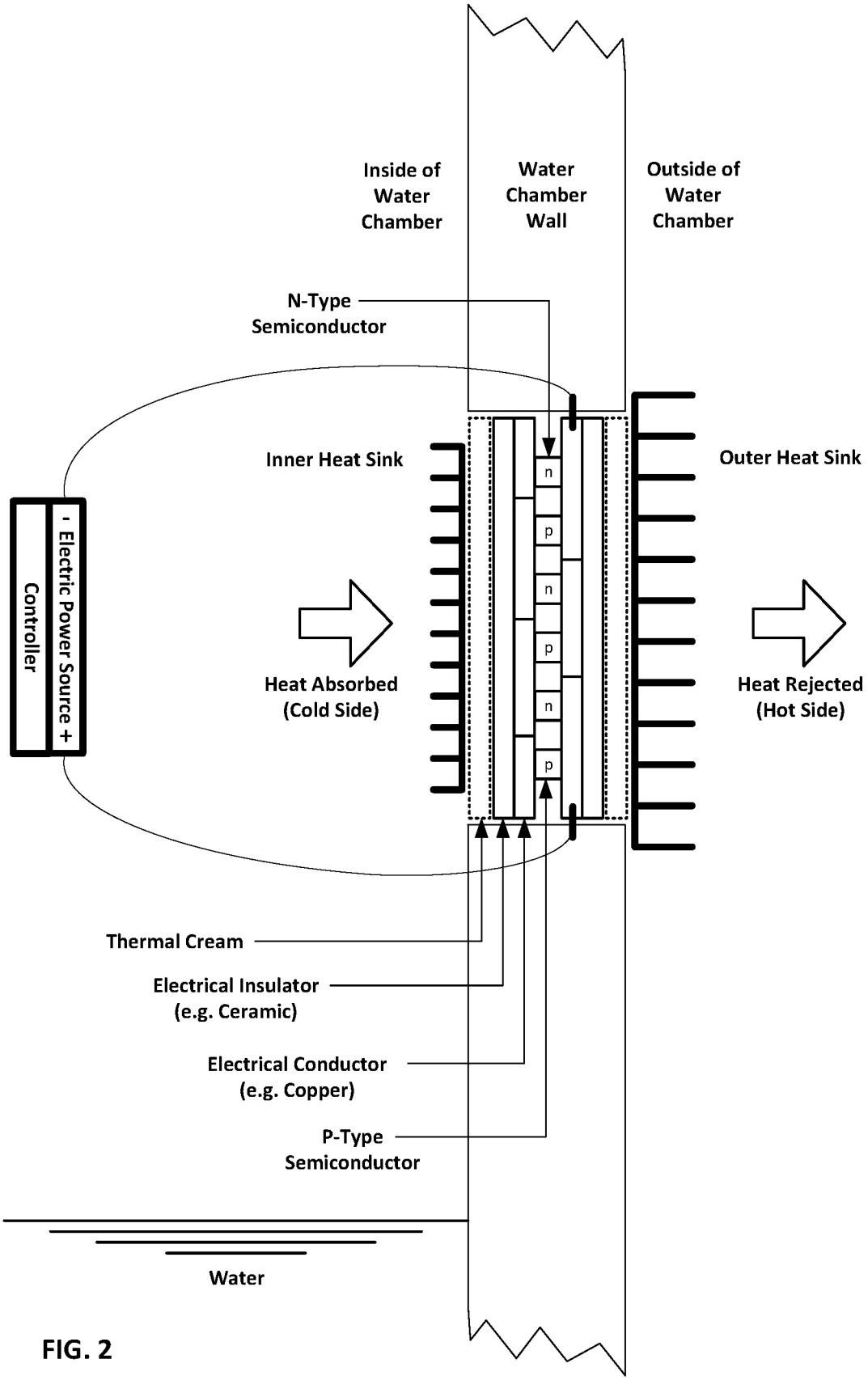
FIG. 2, is a schematic diagram of an exemplary thermoelectric cooling apparatus for a hookah water pipe including components thereof and their interrelations, in accordance with some embodiments of the present invention.

Reference is now made to FIG. 2, where there is shown a schematic diagram of an exemplary thermoelectric cooling apparatus of a water pipe including components thereof and their interrelations, in accordance with some embodiments of the present invention.

In the figure, the TEC is shown to be positioned within an opening in the wall of the water chamber of the water pipe. The inner heat sink is shown to be positioned within the chamber and aligned with the internal surface of the water chamber wall. The outer heat sink is shown to be positioned outside the chamber and aligned with the external surface of the water chamber wall. The TEC transfers heat absorbed by the inner heat sink to the outer heat sink where it is rejected to the environment.

The shown TEC is positioned within an opening in the water chambers' wall, is powered by the electric power source and its operation is managed by the shown controller. The sides/surfaces of the TEC are connected to each of the heat sinks with a layer of thermal cream. Electrical insulator layers of the TEC are positioned between the thermal cream and, electrical conductor layers alternately connecting and conducting between P-Type and N-Type semiconductor elements collectively forming the central layer of the TEC. The power source is connected to electrodes of the more external/outer conductor layer.

Heat within the water chamber is absorbed by the inner heat sink and transferred by the TEC from its cold inner side to its hot outer side and on to the outer heat sink. The outer heat sink then rejects the heat into the surrounding air/environment.

Figure 3:
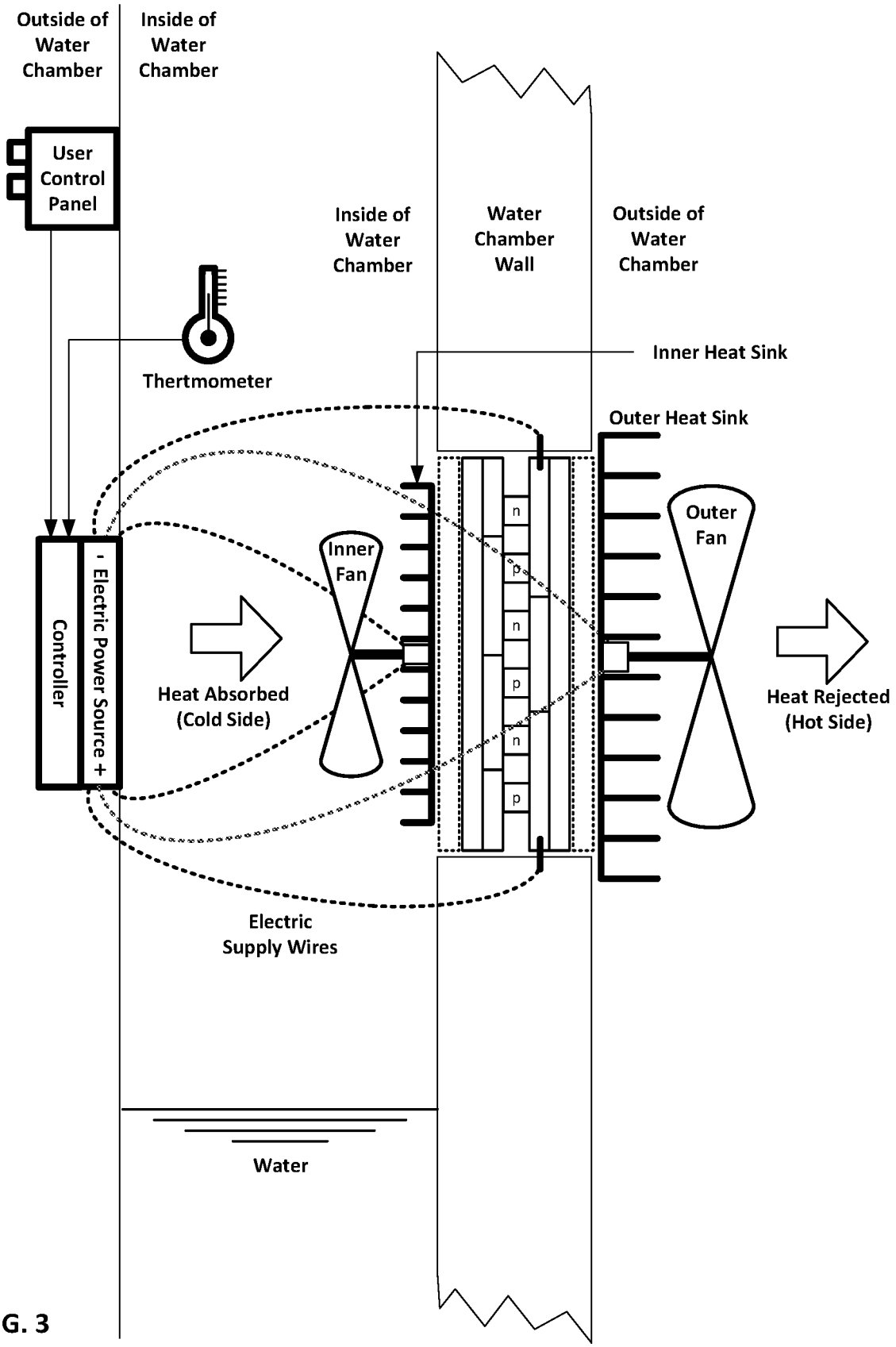
FIG. 3, is a schematic diagram of an exemplary thermoelectric cooling apparatus for a hookah water pipe, further including fans, a thermometer and a user control panel, in accordance with some embodiments of the present invention.

Reference is now made to FIG. 3, where there is shown a schematic diagram of an exemplary thermoelectric cooling apparatus of a water pipe, further including fans, a thermometer and a user control panel, in accordance with some embodiments of the present invention. In the figure, an outer fan and an inner fan are shown to be respectively connected to the outer heat sink and inner heat sink.

The outer fan is functionally connected, and oriented in relation, to the outer heat sink, to displace air carrying heat rejected by the outer heat sink, replacing it with colder ambient air, thereby facilitating/enhancing the chilling pace and/or chilling capability of the interior of the water pipe's chamber.

The inner fan is functionally connected, and oriented in relation, to the inner heat sink, to displace colder air at the proximity of the inner heat sink, directing air carrying heat accumulated within the chamber of the water pipe towards the inner heat sink, thereby facilitating/enhancing the chilling pace and/or chilling capability of the interior of the water pipe's chamber.

The controller manages the operation of the TEC and the fans based on commands received from the user control panel and/or based on temperature readings received from the thermometer.

The user control panel is used for commanding the controller to initiate, halt, raise and/or lower the supply of electric power to the TEC, the outer fan and/or the inner fan. The controller, and/or a control/circuitry logic functionally associated therewith, may further initiate, halt, raise and/or lower the supply of electric power to the TEC, the outer fan and/or the inner fan, based on one or more temperature value readings received from the thermometer.

A measured temperature value above a predefined threshold value triggers or enhances the operation of the TEC, heat sink fan(s), the water cooling block pump and/or the radiator fan. A set of measured temperature values—optionally within a predefined period of time—above a predefined threshold value triggers or enhances the operation of the TEC, heat sink fan(s) and/or, of a pump and/or radiator fan of an outer heat sink of a 'water cooling block' type.

A measured temperature value below a predefined threshold value halts or diminishes the operation of the TEC, heat sink fan(s), the water cooling block pump and/or the radiator fan. A set of measured temperature values—optionally within a predefined period of time—below a predefined threshold value halts or diminishes the operation of the TEC, heat sink fan(s) and/or, of a pump and/or radiator fan of an outer heat sink of a 'water cooling block' type.

Further shown in the figure are electric supply wires running from the electric power source to the TEC, the outer fan and the inner fan.

Figure 4:
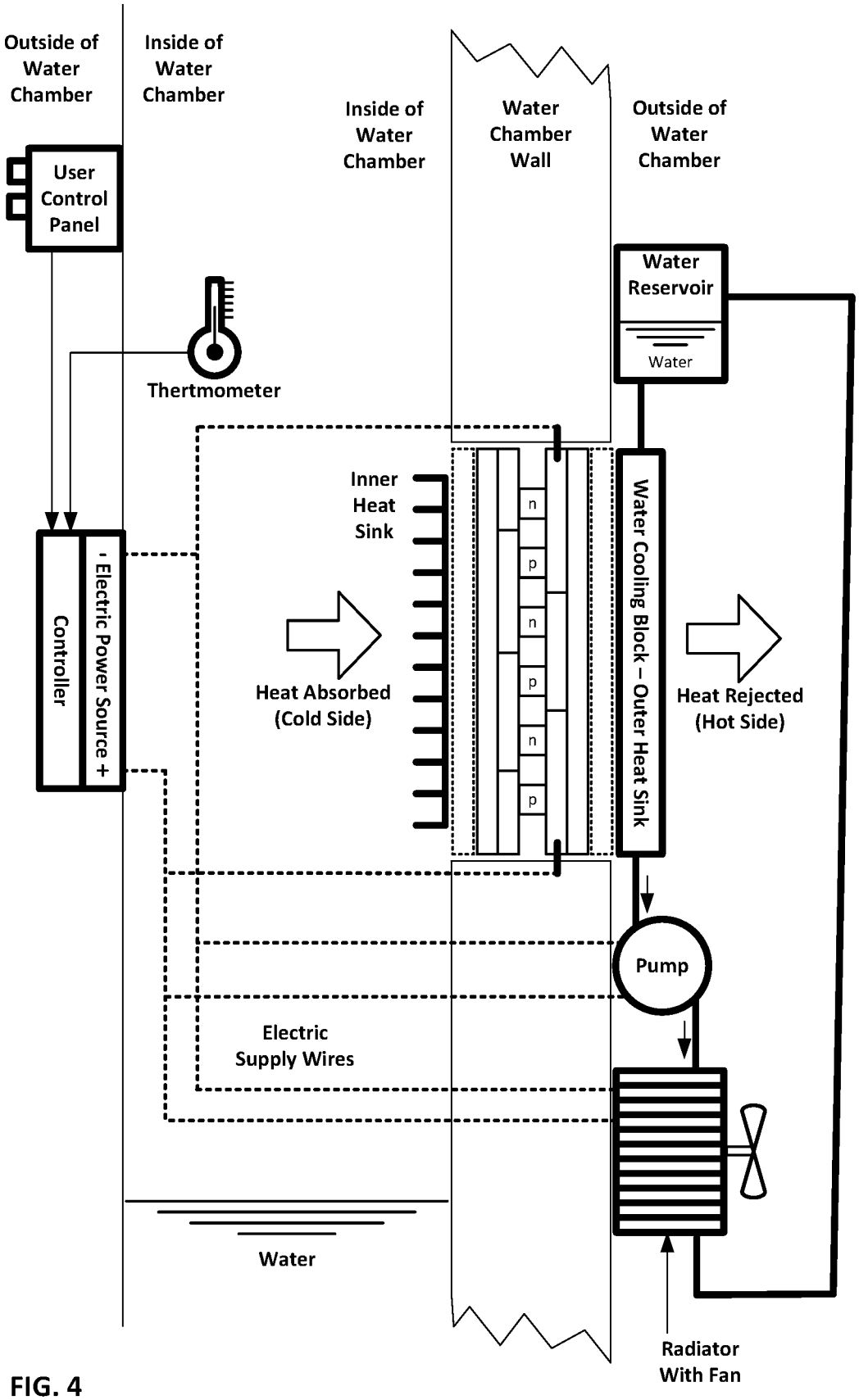
FIG. 4, is a schematic diagram of an exemplary thermoelectric cooling apparatus for a hookah water pipe, wherein the outer heat sink is a water cooling block, in accordance with some embodiments of the present invention.

Reference is now made to FIG. 4, where there is shown a schematic diagram of an exemplary thermoelectric cooling apparatus of a water pipe, wherein the outer heat sink is a water cooling block.

In the figure, the water cooling block is shown to be connected as part of an iterative fluid/water system's cycle. The shown pump, pumps fluid/water heated by absorbing heat rejected from the TEC's hot side, towards and through the shown radiator that rejects heat from the water to the ambient environment, optionally with the assistance of the show fan. Radiator chilled water then continue their way to a water reservoir and from the reservoir—chilled and able to absorb heat rejected from the TEC's hot outer side—back into the water cooling block.

Further shown in the figure are electric supply wires running from the electric power source to the TEC, the pump and the radiator fan.

Figure 5A:
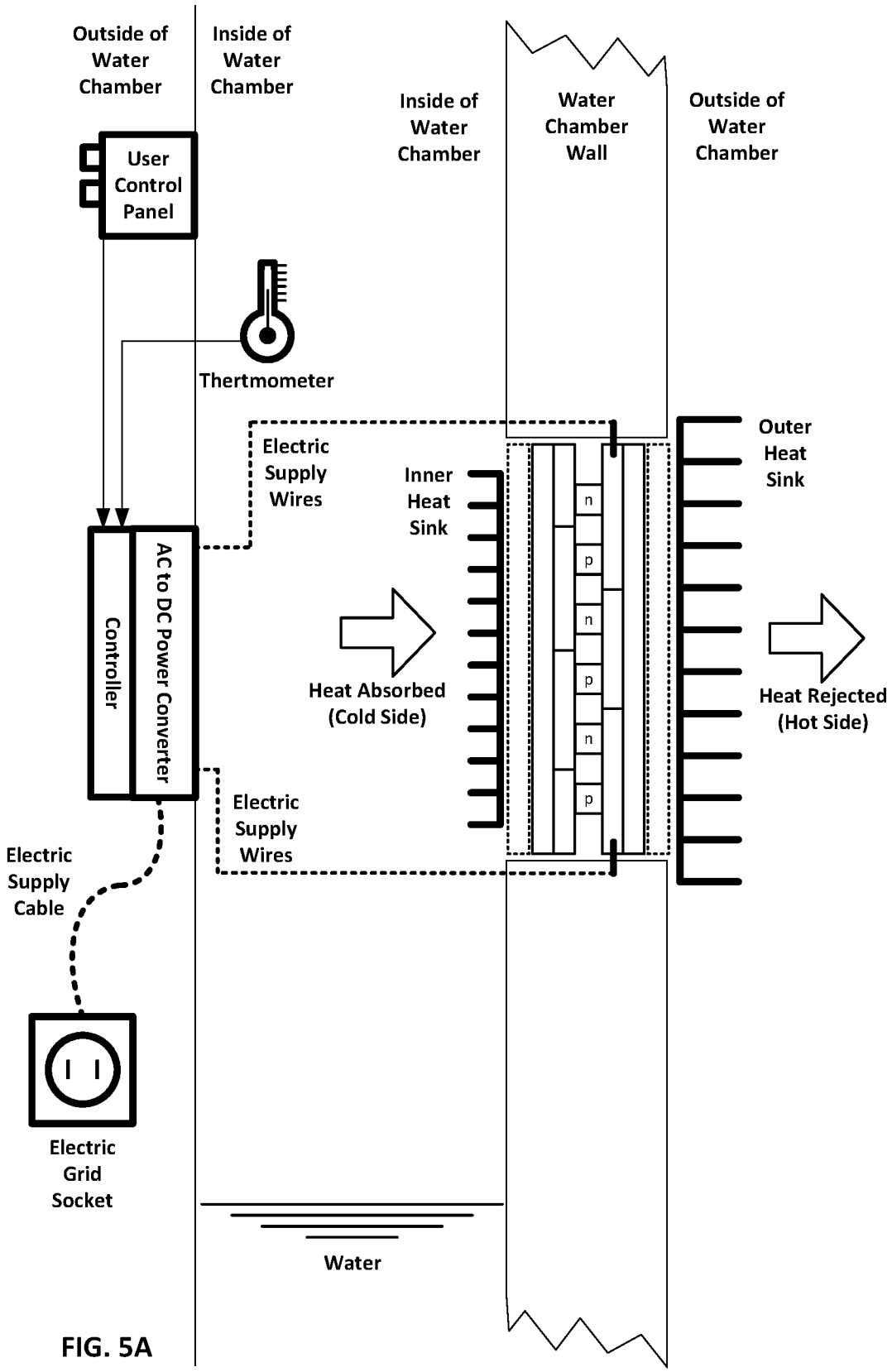
FIG. 5A, is a schematic diagram of an exemplary thermoelectric cooling apparatus for a hookah water pipe, wherein the power source of the cooling apparatus is an AC to DC power converter, in accordance with some embodiments of the present invention.

Reference is now made to FIG. 5A, where there is shown a schematic diagram of an exemplary thermoelectric cooling apparatus of a water pipe, wherein the power source of the cooling apparatus is an AC to DC power converter. The power converter is shown to receive electric AC power through an electric cable from the electric grid and to supply DC power to the TEC and optionally to any combination of other electrically powered components, of the water pipe and/or the chilling apparatus, described herein.

Figure 5B:
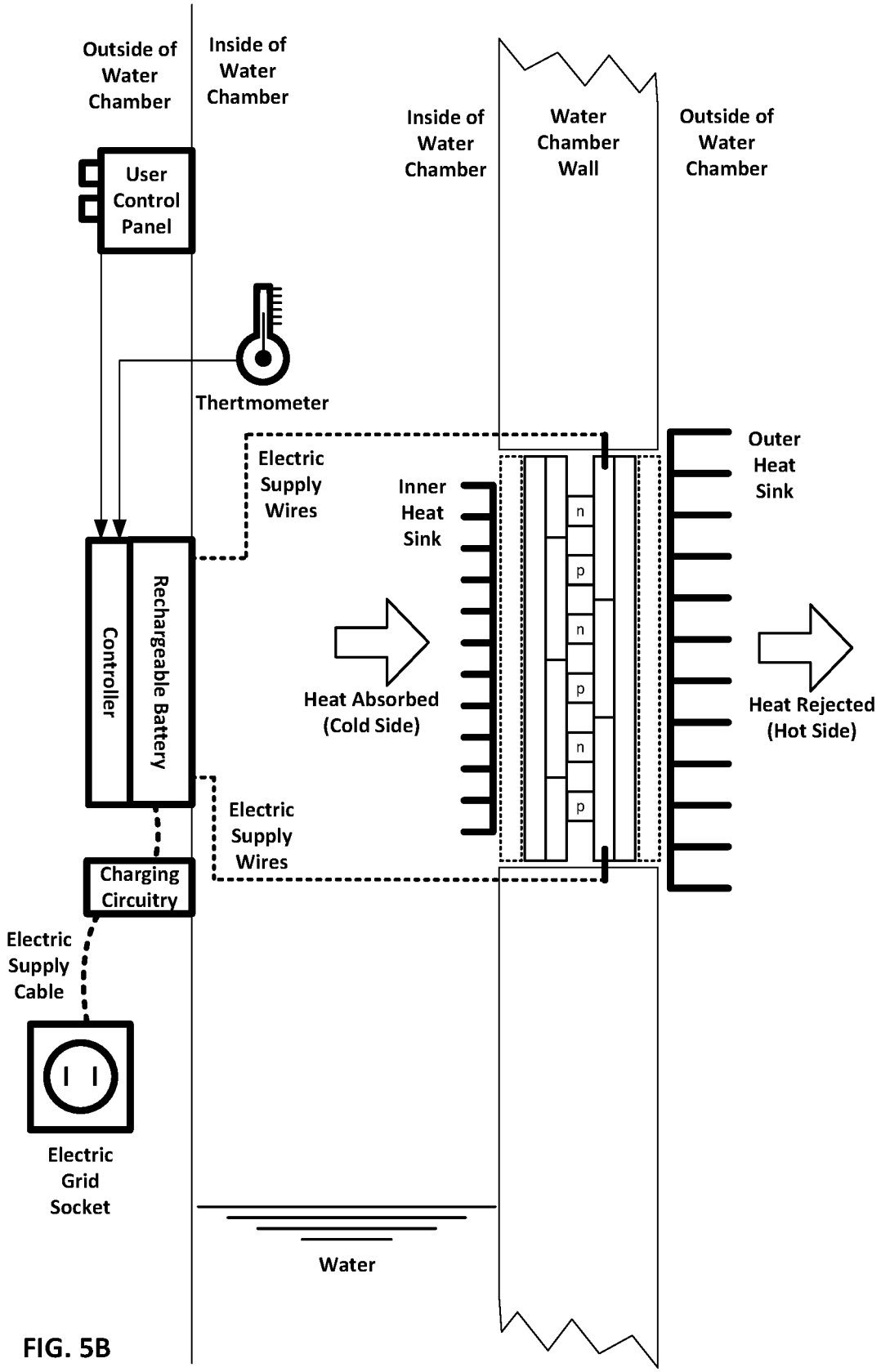
FIG. 5B, is a schematic diagram of an exemplary thermoelectric cooling apparatus for a hookah water pipe, wherein the power source of the cooling apparatus is a rechargeable battery, in accordance with some embodiments of the present invention.

Reference is now made to FIG. 5B, where there is shown a schematic diagram of an exemplary thermoelectric cooling apparatus of a water pipe, wherein the power source of the cooling apparatus is a rechargeable battery. The rechargeable battery is shown to receive electric DC charging power from the shown charging circuitry. The charging circuitry receives electric AC power through an electric cable from the electric grid. The rechargeable battery supplies DC power to the TEC and optionally to any combination of other electrically powered components, of the water pipe and/or the chilling apparatus, described herein.

Figure 6A:
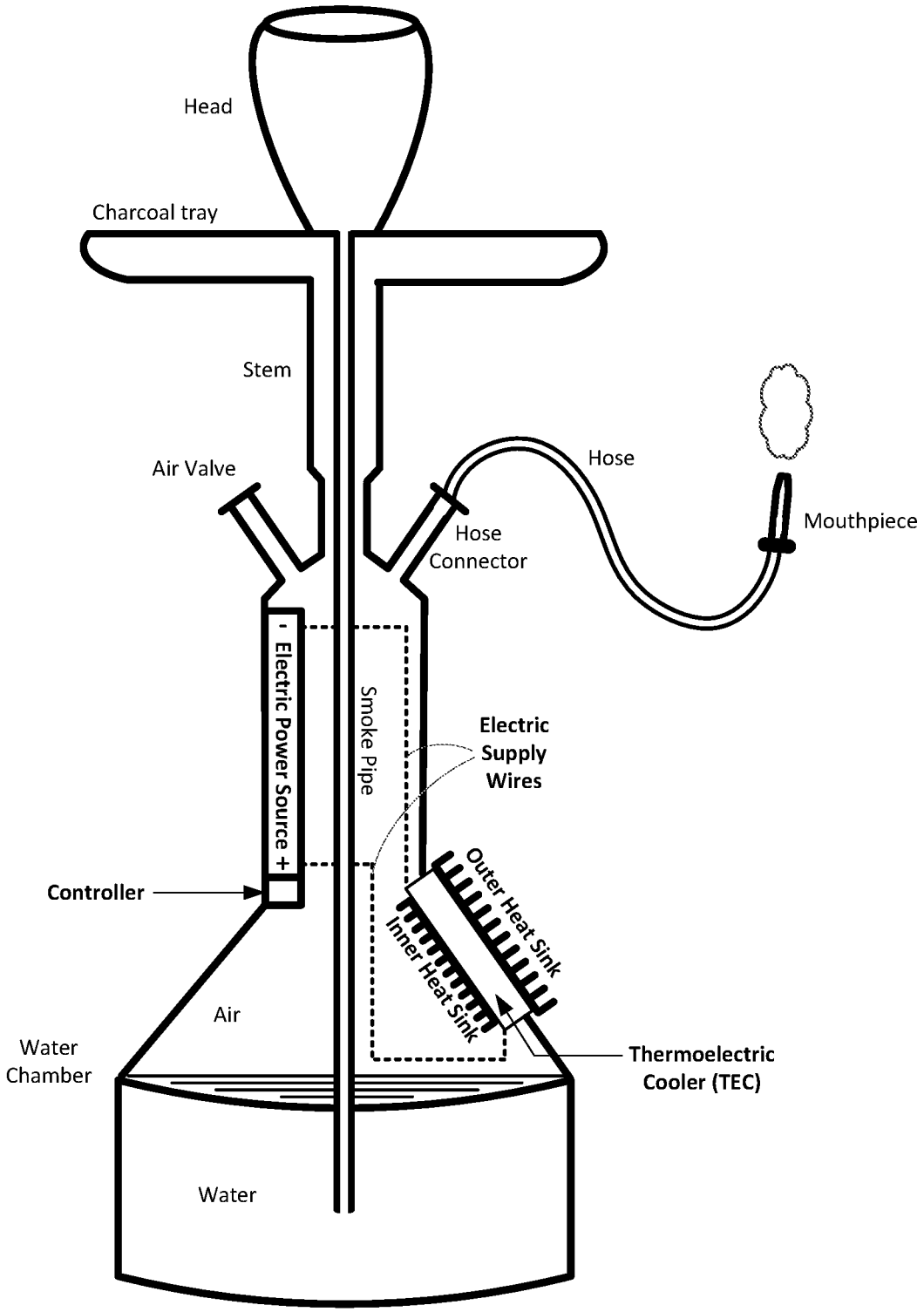
FIG. 6A, is a schematic diagram of an exemplary hookah water pipe including a thermoelectric cooling apparatus, in accordance with some embodiments of the present invention, wherein the cooling apparatus is located at a substantially low section of the water chamber, above the water level within the chamber.

Reference is now made to FIG. 6A, where there is shown a schematic diagram of an exemplary water pipe including a thermoelectric cooling apparatus, in accordance with some embodiments of the present invention, wherein the cooling apparatus is located at a substantially low section of the water chamber, above the water level within the chamber.

Figure 6B:
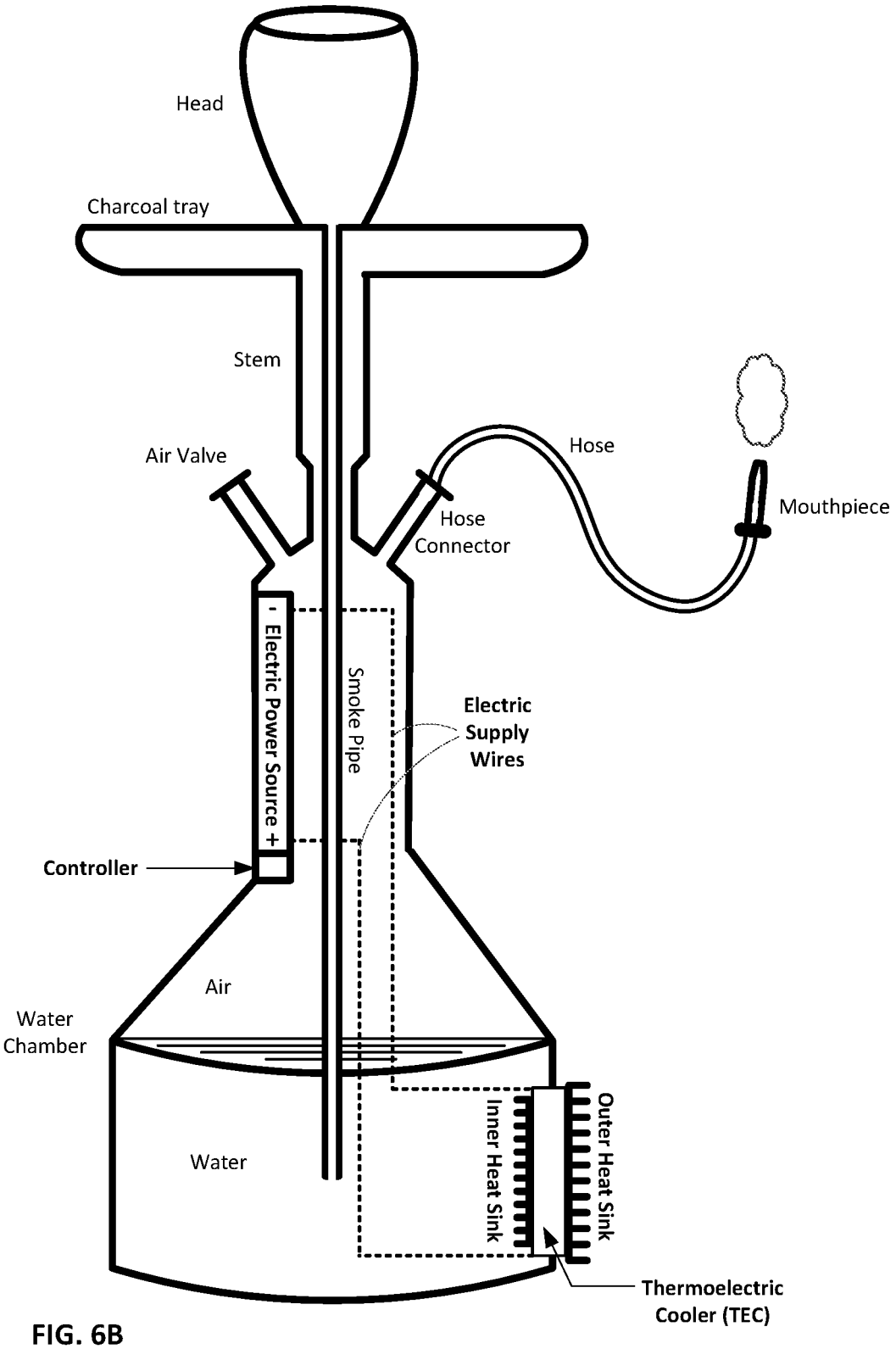
FIG. 6B, is a schematic diagram of an exemplary hookah water pipe including a thermoelectric cooling apparatus, in accordance with some embodiments of the present invention, wherein the cooling apparatus is located at a substantially low section of the water chamber, below the water level within the chamber.

Reference is now made to FIG. 6B, where there is shown a schematic diagram of an exemplary water pipe including a thermoelectric cooling apparatus, in accordance with some embodiments of the present invention, wherein the cooling apparatus is located at a substantially low section of the water chamber, below the water level within the chamber.

Figure 6C:
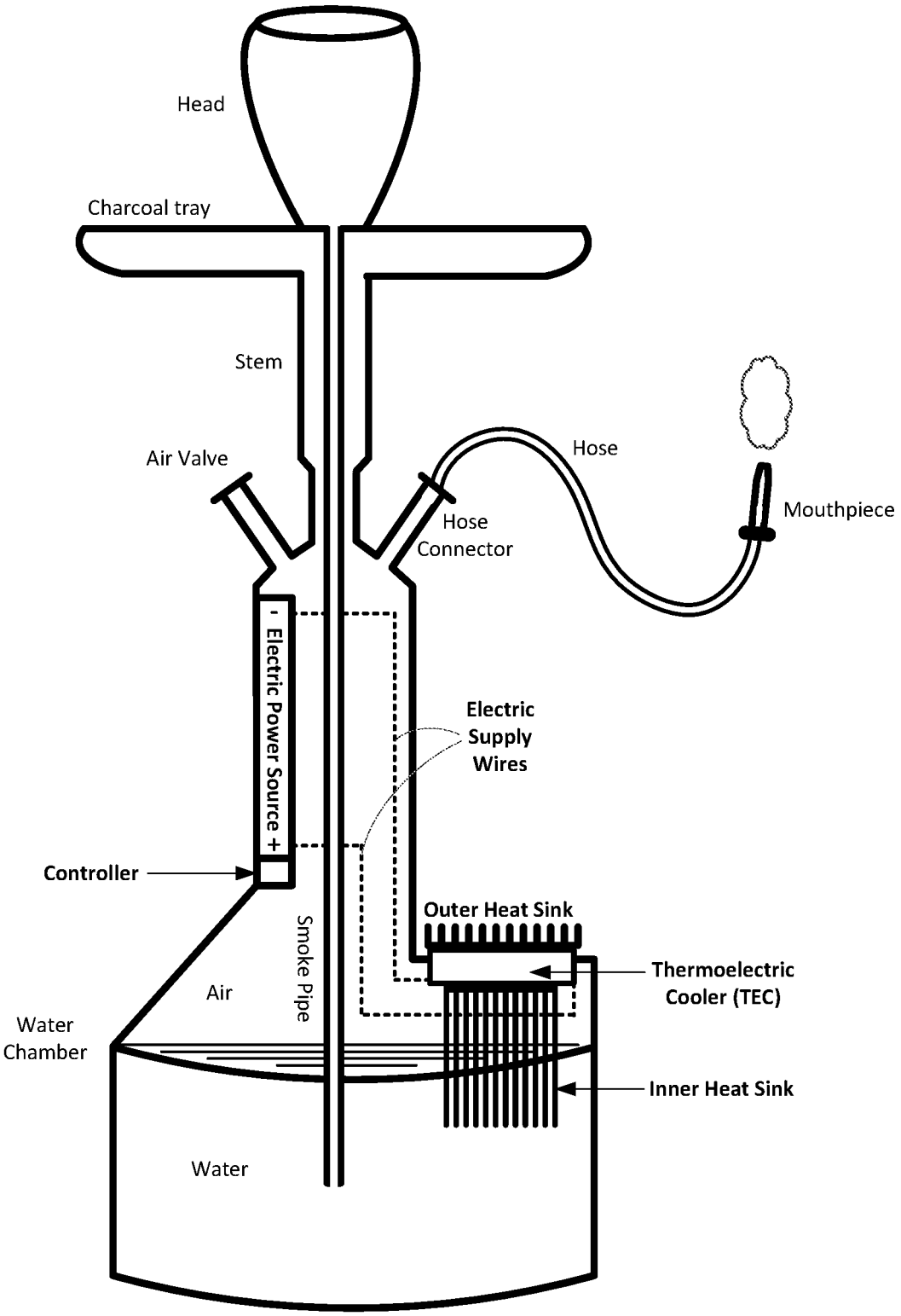
FIG. 6C, is a schematic diagram of an exemplary hookah water pipe including a thermoelectric cooling apparatus, in accordance with some embodiments of the present invention, wherein the cooling apparatus is located at a substantially low section of the water chamber above the water level within the chamber and the partitions/ribs of the inner heat sink protract downwards and reach below the water level within the chamber.

Reference is now made to FIG. 6C, where there is shown a schematic diagram of an exemplary water pipe including a thermoelectric cooling apparatus, in accordance with some embodiments of the present invention, wherein the cooling apparatus is located at a substantially low section of the water chamber above the water level within the chamber and the partitions/ribs of the inner heat sink protract downwards and reach below the water level within the chamber.

Figure 7:
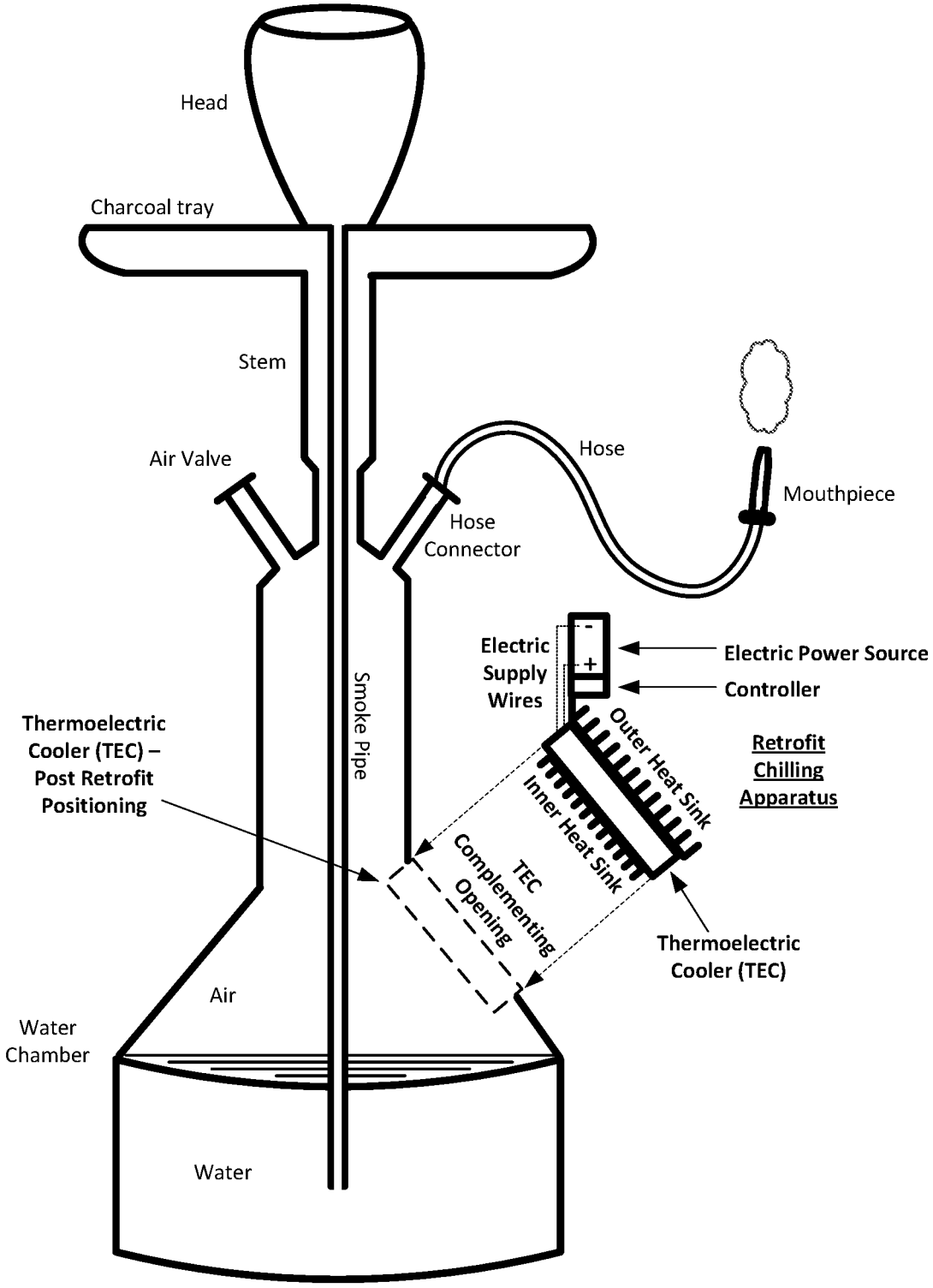
FIG. 7, is a schematic diagram of an exemplary hookah water pipe and an exemplary retrofit chilling apparatus thereof, in accordance with some embodiments of the present invention.

Reference is now made to FIG. 7, where there is shown a schematic diagram of an exemplary retrofit chilling apparatus for a water pipe, in accordance with some embodiments of the present invention, wherein the retrofit chilling apparatus is shown to include: a power source, a controller, a thermoelectric cooler, an inner heat sink and an outer heat sink. The retrofit apparatus and thermoelectric cooler thereof are shown to be sized, shaped and structured to fit into a TEC complementing opening in the wall of the water chamber of the water pipe. The 'post retrofit positioning' of the TEC—upon the retrofit apparatus being mobilized along the broken line arrows and fitted into its complementing opening—is shown by the broken line rectangle at the tip of the arrows.

The retrofit apparatus may be structured, as exemplified in the figure, such that once the TEC is positioned in its complementary opening: the inner heat sink is mostly or fully within the water chamber, the outer heat sink is mostly or fully outside the water chamber, the thin sides of the TEC at least partially overlap with the wall of the water chamber and/or the electric power source and controller are positioned adjacent to the outside of the wall of the water chamber.

According to some embodiments of the present invention, a water pipe may comprise: an inner heat sink positioned within a water chamber of the water pipe; an outer heat sink positioned outside the water chamber of the water pipe; a thermoelectric cooler (TEC) having a heat absorbing side connected to the inner heat sink and a heat rejecting side connected to the outer heat sink; an electric power source for supplying power to the TEC; and a controller configured to adjust power supply from the electric power source to the TEC.

According to some embodiments, the water pipe may further comprise a fan connected to the outer heat sink.

According to some embodiments, the water pipe may further comprise a fan connected to the inner heat sink.

According to some embodiments, the controller may adjust power to the outer fan.

According to some embodiments, the outer heat sink may be a cooling block.

According to some embodiments, the cooling block may be liquid filled.

According to some embodiments, the power source may be a rechargeable battery.

According to some embodiments, the power source may be an AC to DC converter.

According to some embodiments, the inner sink may be positioned at a top section of the pipe chamber above the water level in the chamber.

According to some embodiments, the inner sink may be positioned at a bottom section of the pipe chamber below the water level in the chamber.

According to some embodiments, the inner sink may be positioned at a top section of the pipe chamber above the water level in the chamber, the inner sink having heat absorbing ribs protracting downward and reaching below the water level in the chamber.

According to some embodiments, the water pipe may further comprise a thermometer positioned inside the pipe chamber.

According to some embodiments, the controller may adjust power to the TEC based on temperature based on temperature readings received from the thermometer.

According to some embodiments, the controller may initiate or increase power to the TEC upon one or more temperature reading values surpassing a threshold value.

According to some embodiments, the thermometer may be positioned at an upper section of the space of said water chamber.

According to some embodiments, the thermometer may be positioned at a bottom section of the space of said water chamber.

According to some embodiments, the water pipe may be selected from the group consisting of: a Nargila, a Hookah a Bong, a Pipe and/or any other smoking tool utilizing liquid or fluid to affect characteristic(s) of the tool's produced smoke or vapor.

According to some embodiments, the inner heat sink may be either mostly or completely within the water chamber; the outer heat sink may be either mostly or completely outside the water chamber; and the TEC may complement a hole or opening in the water chamber wherein the edges of the TEC may at least partially overlap with the wall of said water chamber.

According to some embodiments of the present invention, a water pipe may include: an evaporator coil positioned within a water chamber of the water pipe; a condensation coil positioned outside the water chamber of the water pipe; a compressor to pressure gas prior to its entry into the condensation coil; an expansion valve to depressurize gas prior to its entry into the evaporator coil; an electric power source for supplying power to the compressor; and a controller configured to adjust power supply from the electric power source to the compressor.

According to some embodiments of the present invention, an apparatus for chilling a water pipe may comprise: an inner heat sink; an outer heat sink; a thermoelectric cooler (TEC) having a heat absorbing side connected to the inner heat sink and a heat rejecting side connected to the outer heat sink; an electric power source for supplying power to the TEC; a controller configured to adjust power supply from the electric power source to the TEC; and wherein the TEC is shaped to complement an opening in the wall of a water chamber of a water pipe.

The subject matter described above is provided by way of illustration only and should not be constructed as limiting. While certain features of the invention have been illustrated and described herein, many modifications, substitutions, changes, and equivalents will now occur to those skilled in the art. It is, therefore, to be understood that the appended claims are intended to cover all such modifications and changes as fall within the true spirit of the invention.

The invention claimed is:

1. A water pipe comprising:

an inner heat sink positioned within a water chamber of said water pipe;

an outer heat sink positioned outside said water chamber of said water pipe;

a thermoelectric cooler (TEC) having a heat absorbing side connected to said inner heat sink and a heat rejecting side connected to said outer heat sink;

an electric power source for supplying power to said TEC;

a thermometer positioned inside said water chamber; and a controller configured to adjust power supply from said electric power source to said TEC.

2. The water pipe according to claim 1, further comprising a fan connected to said outer heat sink.

3. The water pipe according to claim 2, wherein said controller adjusts power to the outer fan.

4. The water pipe according to claim 1, wherein said outer heat sink is a cooling block.

5. The water pipe according to claim 4, wherein said cooling block is liquid filled.

6. The water pipe according to claim 1, wherein said power source is a rechargeable battery.

7. The water pipe according to claim 6, wherein said power source is an AC to DC converter.

8. The water pipe according to claim 1, wherein said inner sink is positioned at a bottom section of said water chamber below the water level in said water chamber.

9. The water pipe according to claim 1, wherein said inner sink is positioned at a top section of said water chamber above the water level in said water chamber, said inner sink having heat absorbing ribs protracting downward and reaching below the water level in said water chamber.

10. The water pipe according to claim 1, wherein said controller adjusts power to said TEC, based on temperature readings received from said thermometer.

11. The water pipe according to claim 10, wherein said controller initiates or increases power to said TEC, upon one or more temperature reading values surpassing a threshold value.

12. The water pipe according to claim 10, wherein said thermometer is positioned at an upper section of the space of said water chamber.

13. The water pipe according to claim 10, wherein said thermometer is positioned at a bottom section of the space of said water chamber.

14. The water pipe according to claim 1, wherein said water pipe is selected from the group consisting of: a Nargila, a Hookah a Bong and a Pipe.

15. The water pipe according to claim 1, wherein:

said inner heat sink is either mostly or completely within said water chamber;

said outer heat sink is either mostly or completely outside said water chamber; and said TEC complements a hole or opening in the water chamber and the edges of said TEC at least partially overlap with the wall of said water chamber.

16. A water pipe comprising:

an inner heat sink positioned within a water chamber of said water pipe;

an outer heat sink positioned outside said water chamber of said water pipe;

a thermoelectric cooler (TEC) having a heat absorbing side connected to said inner heat sink and a heat rejecting side connected to said outer heat sink;

an electric power source for supplying power to said TEC;

a fan connected to said inner heat sink; and a controller configured to adjust power supply from said electric power source to said TEC.

17. A water pipe comprising:

an inner heat sink positioned within a water chamber of said water pipe at atop section of, and above water level in, said water chamber;

an outer heat sink positioned outside said water chamber of said water pipe;

a thermoelectric cooler (TEC) having a heat absorbing side connected to said inner heat sink and a heat rejecting side connected to said outer heat sink;

an electric power source for supplying power to said TEC; and a controller configured to adjust power supply from said electric power source to said TEC.

* * * * *